US005122997A

United States Patent [19]

Schneider et al.

[11] Patent Number: 5,122,997

[45] Date of Patent: Jun. 16, 1992

[54] WATCH HAVING A ROTATABLE BEZEL

[75] Inventors: Henri Schneider, Sonvilier; Pablo Fernandez, La Chaux-de-Fonds, both of Switzerland

[73] Assignee: Roventa-Henex SA, Switzerland

[21] Appl. No.: 540,086

[22] Filed: Jun. 19, 1990

[30] Foreign Application Priority Data

Jun. 19, 1989 [EP] European Pat. Off. ..... 89810469

[51] Int. Cl.[5] ..... G04B 37/00; G04B 39/00

[52] U.S. Cl. ..... 368/294; 368/295

[58] Field of Search ..... 368/294–296

[56] References Cited

U.S. PATENT DOCUMENTS

| | | | |
|---|---|---|---|
| 3,548,588 | 12/1970 | Piquerez | 368/294 |
| 4,244,044 | 1/1981 | Olsson | 368/294 |
| 4,420,264 | 12/1983 | Murata | 368/294 |
| 4,815,053 | 3/1985 | Dal Busco | 368/294 |

FOREIGN PATENT DOCUMENTS

| | | | |
|---|---|---|---|
| 216420 | 1/1987 | European Pat. Off. . | |
| 1224391 | 6/1960 | France | 368/295 |
| 55-70767 | 5/1980 | Japan | 368/295 |
| 214225 | 4/1941 | Switzerland . | |
| 3288/69 | 10/1972 | Switzerland . | |
| 631592 | 8/1982 | Switzerland . | |
| 662922 | 11/1987 | Switzerland . | |

*Primary Examiner*—Vit W. Miska

*Attorney, Agent, or Firm*—Ostrolenk, Faber, Gerb & Soffen

[57] ABSTRACT

The watch bezel is mounted on the middle part of the case by means of a wave-shaped inclined spring wire. Between the middle part of the case and the bezel is located a flat spring having inclined tongues forming pawls engaging into the toothing of a toothed ring. This ring is freely located between the middle part of the case and the bezel, and its angular position relatively to the bezel is determined by pins engaging into holes of the bezel. The indexing system of the bezel composed of the toothed ring and of the flat spring with its pawls is thus freely disposed between the bezel and the middle part of the case, and all constituents are maintained in place only by spring force of springs. The elements of the system and its assemblage are particularly simple and inexpensive.

17 Claims, 1 Drawing Sheet

WATCH HAVING A ROTATABLE BEZEL

This invention relates to a watch having a rotatable bezel with an indexing system comprising a toothed ring and at least one pawl engaging into that toothed ring. Prior watches of this kind and particularly their indexing system for positioning the bezel are not satisfactory because their production is relatively expensive and/or assembling of the indexing system is also too complicated and expensive.

Therefore it is an object of this invention to provide a watch having a rotatable bezel with an indexing system particularly simple in production and assembling, it being also very easy to disassemble this system for repair or for replacing defective or worn parts. This ease in assembling and disassembling allows the use of relatively simple elements made of a convenient material which may have a low resistance to wear because these elements may easily be replaced. These and other objects are achieved by the fact that said toothed ring is a part separate from said bezel and from the middle part of the watch case. In other words said ring is an element loosely mounted between the middle part of the watch case and the bezel without any fixing elements, this allowing the use of simple elements which may also simply be assembled.

Preferably said pawl or pawls cooperating with said toothed ring are also part of an element separate from said bezel and from said middle part of the watch case, that is, said pawls are parts of an element loosely mounted between the middle part of the watch and the bezel.

This invention will now be explained in detail with reference to the attached drawing showing by way of example two embodiments of a watch according to this invention.

Figure 1:
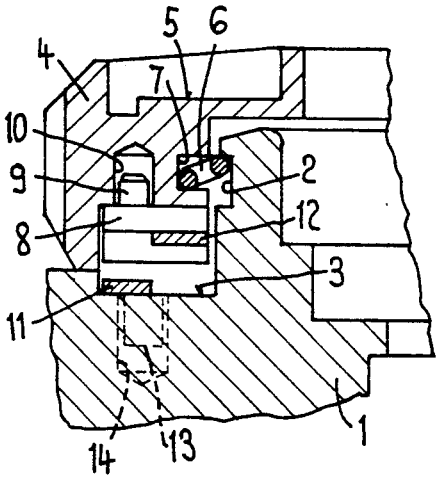
FIG. 1 is a radial section.
Figure 2:
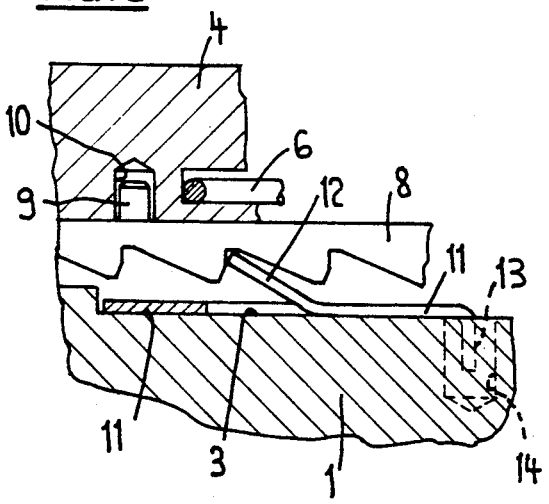
FIG. 2 is a circumferential section of the first embodiment.

The watch partially illustrated in FIG. 1 and 2 comprises a middle part 1 of the watch case wherein a watch movement not shown in the figures is mounted. The middle part of the watch case has two annular grooves 2 and 3 serving for mounting the bezel 4. Symbols, for instance ciphers or divisons, are provided at the bottom 5 of an annular groove of the bezel 4. The bezel 4 is mounted on the middle part 1 of the watch case by means of a waveshaped spring wire 6 slightly inclined and engaging into the groove 2 of the middle part 1 of the watch case and into a groove 7 of the bezel 4. By this spring 6 the bezel 4 is urged downwardly against a shoulder of the middle part 1. A toothed ring 8 is loosely located between the bezel 4 and the middle part 1 of the case. The angular position of this ring 8 with reference to the bezel 4 is determined by pins or projections 9 of ring 8 engaging into holes 10 of the bezel 4. A flat spring 11 having a few elastic tongues 12 is located in the groove 3 of the middle part 1 of the case, said tongues 12 being pawls engaging into the teeth of ring 8. The pawls 12 are uniformely distributed round the circumference. Moreover, the spring 11 comprises projections 13 which engage into holes 14 of the middle part 1 of the case for determining the angular position of the flat spring 11 and of the pawls 12 relatively with reference to the middle part of the case.

The ring 8 and the flat spring 11 constitute and indexing system for the bezel, this system being freely and loosely held between the middle part 1 of the case and the bezel 4 simply under the pressure of springs 6 and 11. On one hand the bezel 4 is maintained in its illustrated position by the spring 6 whereas the ring 8 is maintained in its position in touch with the bezel and with its pins 9 engaging into the holes 10 by the elasticity of the pawls 12 made in one piece with the flat spring 11. It is thus obvious that the indexing system is made of extremely simple and cheap elements and that assembling of this system and of the bezel respectively with its indexing system is also extremely simple. By pulling the bezel upwardly it may be removed by a slight compression of spring 6 for replacing a defective ring 8 or spring 11. In this way it is possible to provide a ring made of plastic material which is cheap and which may easily be replaced. The system may be used with any type watch of bezel of metal or of plastic material.

Figure 3:
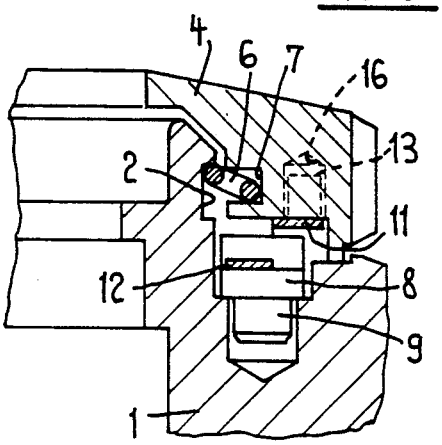
FIG. 3 is a radial section.
Figure 4:
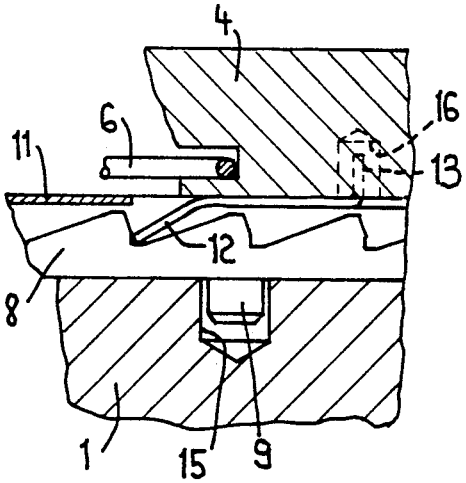
FIG. 4 is a circumferential section of the second embodiment.

In FIGS. 3 and 4 corresponding elements are designated by the same reference numerals as in FIGS. 1 and 2. The embodiment according to FIGS. 3 and 4 substantially distinguishes from the embodiment according to FIGS. 1 and 2 by the fact that the toothed ring 8 is placed at the side of the middle part 1 of the case while the flat spring 11 is placed at the side of the bezel 4. The projections or pins 9 of the ring 8 engage into holes 15 of the middle part of the case while tongues 13 of the spring 11 engage into holes 16 of the bezel 4.

What we claim is:

1. A watch with a rotatable, indexable bezel, comprising:

the watch having a middle part, and the middle part having an axial end with a periphery;

a bezel over and rotatable around the axial end of the middle part, generally around the periphery thereof;

the bezel and the middle part being respectively so shaped as to define an annular space between them generally at the periphery of the middle part;

an indexing system in the annular space, the indexing system comprising a toothed ring, which is a separate element from the bezel and from the middle part, the toothed ring having teeth facing into the annular space; and an elastic element, which is also a separate element from the bezel and the middle part and from the toothed ring, extending elastically into the teeth for restraining rotation of the bezel around the middle part periphery; the toothed ring and the elastic element being urged against each other by their engagement against the bezel and the middle part.

2. The watch of claim 1, further comprising second elastic means removably securing the bezel to the middle part, the second elastic means being deformable to enable separation of the bezel from the middle part.

3. The watch of claim 1, wherein the elastic element comprises a pawl and a support for the pawl in the annular space, the pawl being supported and oriented by the support to extend into the teeth of the tooth ring.

4. The watch of claim 1, wherein the toothed ring is separably engagable with the bezel, and the elastic element is separably engagable with the middle part of the watch.

5. The watch of claim 1, wherein the toothed ring is separably engagable with the middle part of the watch, and the elastic element is separably engagable with the bezel.

6. The watch of claim 1, further comprising the teeth of the toothed ring and the elastic element being so oriented in the annular space as to normally urge the bezel off the middle part; and second elastic means normally urging the bezel oppositely to the urging of the bezel by the elastic element.

7. The watch of claim 6, wherein the elastic element and the second elastic means are both oriented to act axially of the middle part of the watch and of the bezel.

8. The watch of claim 7, wherein the elastic element comprises a pawl and a support for the pawl in the annular space, the pawl being supported and oriented by the support to extend into the teeth of the toothed ring.

9. The watch of claim 8, wherein pawl support comprises a flat spring extending around the annular space and the pawl is part of the flat spring.

10. The watch of claim 9, wherein the toothed ring is separably engagable with the bezel, and the flat spring is separable engagable with the middle part of the watch.

11. The watch of claim 9, wherein the toothed ring is separably engagable with the middle part of the watch, and the flat spring is separably engagable with the bezel.

12. The watch of claim 7, wherein the second elastic means removably secures the bezel to the middle part, the second elastic means being deformable to enable separation of the bezel from the middle part.

13. The watch of claim 8, wherein the second elastic means comprises a spring wire extending between the bezel and the middle part.

14. The watch of claim 13, wherein the bezel and the middle part have respective generally opposing grooves which are placed for receiving the spring wire and are so placed as to cause the spring wire to urge the bezel axially toward the middle part of the watch.

15. The watch of claim 9, further comprising first connecting means which connect the toothed ring with one of the bezel and the middle part and second connecting means which connect the pawl support with the other of the bezel and the middle part, such that each of the toothed ring and the middle part rotates with the respective one of the bezel and the middle part to which it is connected, the first and second connecting means being separable, whereby upon removal of the bezel from the middle part, the first and second connecting means are released.

16. The watch of claim 14, wherein the connection means on the bezel and the middle part of the watch comprise respective holes in the bezel and in the middle part of the watch and comprise respective projections on the toothed ring and the elastic element, and the projections on one of the toothed ring and the elastic element extending into the holes into the bezel, and the projections on the other of the toothed ring and the elastic element extending into the holes in the middle part of the watch.

17. The watch of claim 7, wherein the toothed ring has axially directed thereon and the elastic element extends axially into the teeth.

* * * * *